US005265939A

United States Patent [19]

Self et al.

[11] Patent Number: 5,265,939

[45] Date of Patent: Nov. 30, 1993

[54] MEANS FOR AND METHOD OF FUNITURE CONSTRUCTION

[76] Inventors: Betty J. Self, Rte. 1, Box 60-A, Thaxton, Miss. 38871; John L. Touchstone, 65 Cypress La., Belden, Miss. 38826

[21] Appl. No.: 795,528

[22] Filed: Nov. 21, 1991

[51] Int. Cl.[5] ..... A47C 7/00

[52] U.S. Cl. ..... 297/440.13; 297/440.15

[58] Field of Search ..... 297/440, 442

[56] References Cited

U.S. PATENT DOCUMENTS 3,704,911 12/1972 Milakovich ..... 297/440

3,973,800 8/1976 Kogan ..... 297/440

FOREIGN PATENT DOCUMENTS 1320715 6/1973 United Kingdom ..... 297/440

*Primary Examiner*—Laurie K. Cranmer

*Attorney, Agent, or Firm*—Walker, McKenzie & Walker

[57] ABSTRACT

Structure for removably joining a first portion, a second portion and a third portion of a furniture piece together. The structure includes a first connector having a first member for being attached to the first portion of the furniture piece and having a second member for being attached to the second portion of the furniture piece in positions so that the first connector will join the first portion of the furniture piece and the second portion of the furniture piece to one another when the first and second members thereof are brought into engagement with one another and the second portion of the furniture piece is moved in a first direction relative to the first portion of the furniture piece; and a second connector having a first member for being attached to the first portion of the furniture piece and having a second member for being attached to the third portion of the furniture piece in positions so that the second connector will join the first portion of the furniture piece and the third portion of the furniture piece to one another when the first and second members thereof are brought into engagement with one another and the third portion of the furniture piece is moved in a second direction relative to the first portion of the furniture piece.

6 Claims, 2 Drawing Sheets

MEANS FOR AND METHOD OF FUNITURE CONSTRUCTION

BACKGROUND OF THE INVENTION

1. Field of the Invention

The present invention relates, in general, to furniture construction, and more specifically to a means for and a method of constructing furniture which allows the furniture to be disassembled for shipping, storage, etc.

2. Description of the Related Art

The shipping and/or storage of relatively large furniture pieces such as sofas, couches, upholstered chairs, etc., can be expensive because of the size of such furniture pieces and/or the size of the boxes required to contain such furniture pieces. La-Z-Boy Chair Company of 1284 N. Telegraph Road, Monroe, Mich. 48161, has marketed a recliner chair in which the seat and arm portions are fixedly attached to one another and the back portion is removably attached to the seat and arm portions by a slide mechanism which allows the back portion to be substantially easily removed from the seat and arm portions whereby the chair can be shipped and/or stored as two separate pieces.

Nothing in the known prior art discloses or suggests the present invention. More specifically, nothing in the known prior art discloses or suggests a joining means used for removably joining a first portion, a second portion and a third portion of a furniture piece together and, including in general, a first connecting means having a first member for being attached to the first portion of the furniture piece and having a second member for being attached to the second portion of the furniture piece in positions so that the first connecting means will join the first portion of the furniture piece and the second portion of the furniture piece to one another when the first and second members of the first connecting means are brought into engagement with one another and the second portion of the furniture piece is moved in a first direction relative to the first portion of the furniture piece; and a second connecting means having a first member for being attached to the first portion of the furniture piece and having a second member for being attached to the third portion of the furniture piece in positions so that the second connecting means will join the first portion of the furniture piece and the third portion of the furniture piece to one another when the first and second members of the second connecting means are brought into engagement with one another and the third portion of the furniture piece is moved in a second direction relative to the first portion of the furniture piece.

SUMMARY OF THE INVENTION

The joining means of the present invention is used for removably joining a first portion, a second portion and a third portion of a furniture piece together, and includes, in general a first connecting means having a first member for being attached to the first portion of the furniture piece and having a second member for being attached to the second portion of the furniture piece in positions so that the first connecting means will join the first portion of the furniture piece and the second portion of the furniture piece to one another when the first and second members of the first connecting means are brought into engagement with one another and the second portion of the furniture piece is moved in a first direction relative to the first portion of the furniture piece; and a second connecting means having a first member for being attached to the first portion of the furniture piece and having a second member for being attached to the third portion of the furniture piece in positions so that the second connecting means will join the first portion of the furniture piece and the third portion of the furniture piece to one another when the first and second members of the second connecting means are brought into engagement with one another and the third portion of the furniture piece is moved in a second direction relative to the first portion of the furniture piece.

DESCRIPTION OF THE PREFERRED EMBODIMENT

Figure 1:
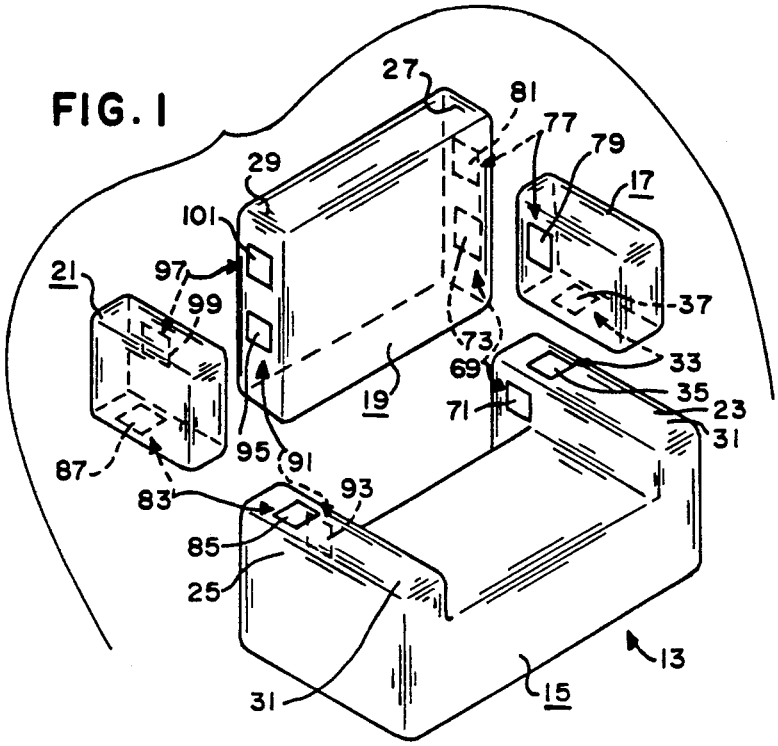
FIG. 1 is a somewhat diagrammatic, exploded perspective view of a furniture piece shown in combination with the joining means of the present invention.

The joining means of the present invention is used in combination with a furniture piece 13 such as a sofa, couch, upholstered chair, etc., and is used especially for removably joining a first portion, a second portion and a third portion of the furniture piece 13 together. More specifically, the furniture piece 13 preferably includes a seat portion 15 (i.e., a first portion), a first side portion 17 (i.e., a second portion), a back portion 19 (i.e., a third portion), and a second side portion 21 (i.e., a fourth portion). The seat portion 15 preferably has a first end 23 and a second end 25. The back portion 19 preferably has a first end 27 and a second end 29. The joining means of the present invention is preferably used to attach the first side portion 17 to the first end 23 of the seat portion 15 and to the first end 27 of the back portion 19, and to attach the second side portion 21 to the second end 25 of the seat portion 15 and to the second end 29 of the back portion 19 in such a manner so that the furniture piece 13 can be stored and transported in disassembled to conserve space, etc. (e.g., the disassembled furniture piece 13 can be stored and transported in a box that is approximately the same size as the seat portion 15) and so that the furniture piece 13 is held securely together once assembled. The specific style, design and appearance of the furniture piece 13 may vary as will now be apparent to those skilled in the art. Thus, for example, the furniture piece 13 may have a generally "Early American" style, the first and second ends 23, 25 of the portion 15 may include arm members 31 and the first and second side portions 17, 21 may define wing portions for being attached to the arm members 31, etc., as will now be apparent to those skilled in the art. On the other hand, the furniture piece 13 may have a generally "modern" style, the seat portion 15 may be "armless," and the first and second side portions 17, 21 may define arm members when attached to the first and second ends 23, 25 of the seat portion 15.

Figure 2:
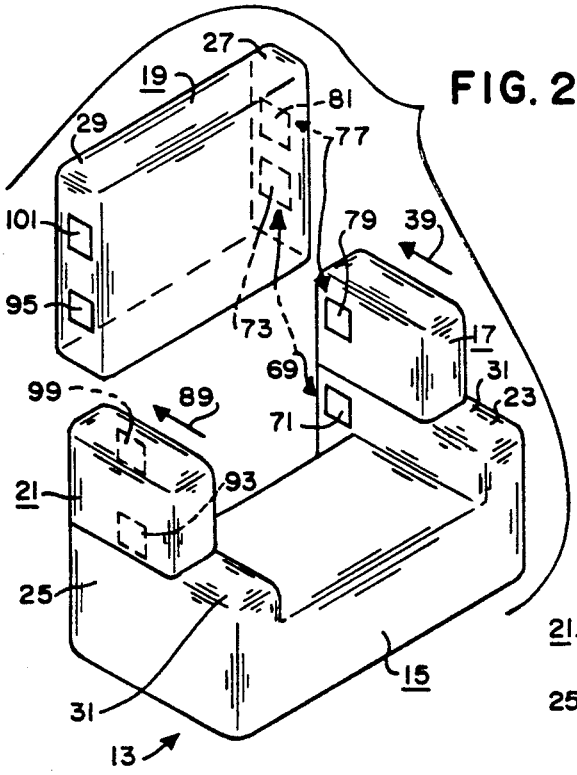
FIG. 2 is an exploded perspective view similar to FIG. 1 but with first and second side portions of the furniture piece attached to the seat portion thereof.

The joining means of the present invention includes a first connecting means 33 for connecting the first side portion 17 and the first end 23 of the seat portion 15 together (see FIGS. 1 and 4–7). The first connecting means 33 includes a first member 35 for being attached to the first end 23 of the seat portion 15 and includes a second member 37 for being attached to the first side portion 17 in positions so that the first connecting means 33 will join the first end 23 of the seat portion 15 and the first side portion 17 to one another when the first and second members 35, 37 are brought into engagement with one another and the first side portion 17 is moved in a first direction relative to the seat portion 15 as indicated by the arrow 39 in FIG. 2. The first connecting means 33 may be constructed in various specific manners which allow the seat portion 15 and the first side portion 17 to be joined together when the first and second members 35, 37 are brought into engagement with one another and the first side portion 17 is moved in a first direction relative to the seat portion 1 5 as indicated by the arrow 39 in FIG. 2.

Figure 4:
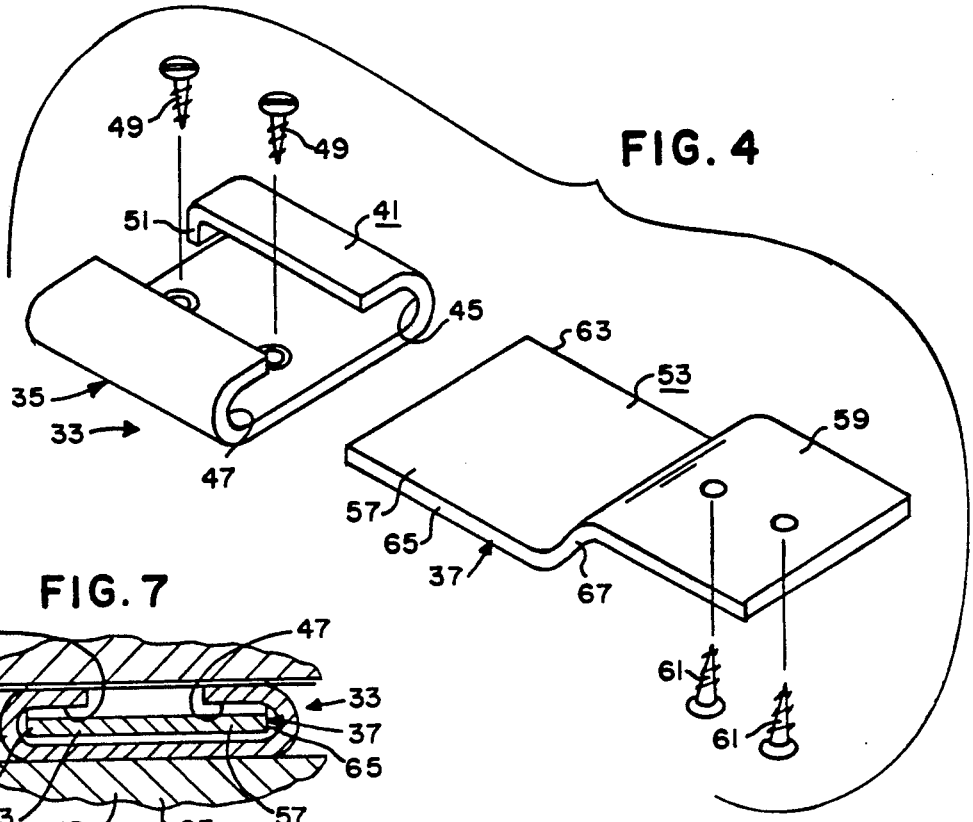
FIG. 4 is an exploded perspective view of a connecting means of the joining means of the present invention.
Figure 7:
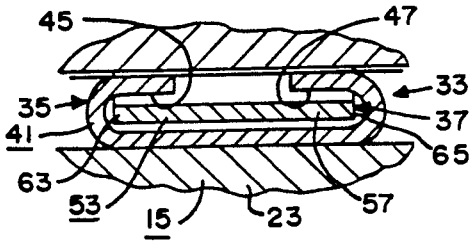
FIG. 7 is a sectional view substantially as taken on line 7—7 of FIG. 6.

The first member 35 preferably includes a slide member 41 having inwardly facing, elongated channels 45, 47 at the lateral edges thereof as clearly shown in FIGS. 4 and 7. The slide member 41 may be fixedly attached to the first end 23 of the seat portion 15 in any manner now apparent to those skilled in the art. Thus, for example, the first connecting means 33 may include one or more screw members 49 for extending through apertures in the base of the slide member 41 and into the first end 23 of the seat portion 15 to secure the slide member 41 to the first end 23 of the seat portion 15. Stop means 51 is preferably provided at one end of each channel 45, 47 for reasons which will hereinafter become apparent. Each stop means 51 may be formed by merely crimping or otherwise closing one end of each channel 45, 47 as will now be apparent to those skilled in the art. The slide member 41 may be constructed in various manners and out of various materials as will now be apparent to those skilled in the art. Thus, for example, the slide member 41 may be machined and bent out of a rigid metal plate or the like.

The second member 37 may include a slide member 53 for coacting with the slide member 41. The slide member 53 preferably has a tongue portion 57 for sliding into the channels 45, 47 of the slide member 41, and has a base portion 59 for being fixedly attached to the first side portion 17 in any manner now apparent to those skilled in the art. Thus, for example, the first connecting means 33 may include one or more screw members 61 for extending through apertures in the base portion 59 and into the first side portion 17 to secure the slide member 53 to the first side portion 17. The tongue portion 57 is sized so that the opposite edges 63, 65 thereof will enter the channels 45, 47 when the first and second members 35, 37 are brought into engagement with one another and the first side portion 17 is moved in the first direction relative to the seat portion 15 as indicated by the arrow 39 in FIGS. 2 and 6 to thereby secure the seat portion 15 and the first side portion 17 together and prevent the separation thereof except by moving the first side portion 17 in a direction opposite the first direction indicated by the arrow 39 as will now be apparent to those skilled in the art. The body of the slide member 53 preferably has a bend portion 67 joining the tongue portion 57 and the base portion 59 to off-set the tongue portion 57 from the base portion 59 so that the tongue portion 57 will be spaced slightly away from the first side portion 17 when the base portion 59 is secured to the first side portion 17 as clearly shown in FIGS. 5, 6 and 7 to allow the tongue portion 57 to easily slide into the channels 45, 47 as will now be apparent to those skilled in the art. It should be noted that if the stop means 51 is omitted from the first member 35 and the bend portion 67 provided with notches or the like to pass over the channels 45, 47, etc., the seat portion 15 and first side portion 17 could also be separated by moving the first side portion 17 further in the direction of the arrow 39 as will now be apparent to those skilled in the art. The slide member 53 may be constructed in various manners and out of various materials as will now be apparent to those skilled in the art. Thus, for example, the slide member 53 may be machined and bent out of a rigid metal plate or the like.

Figure 3:
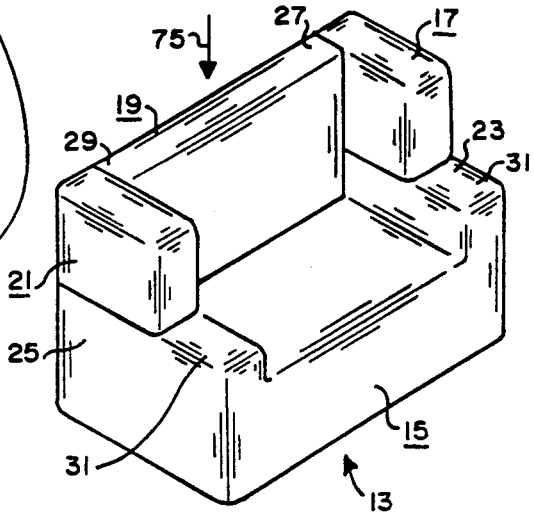
FIG. 3 is a perspective view of the furniture piece of FIG. 1 fully assembled.
Figure 5:
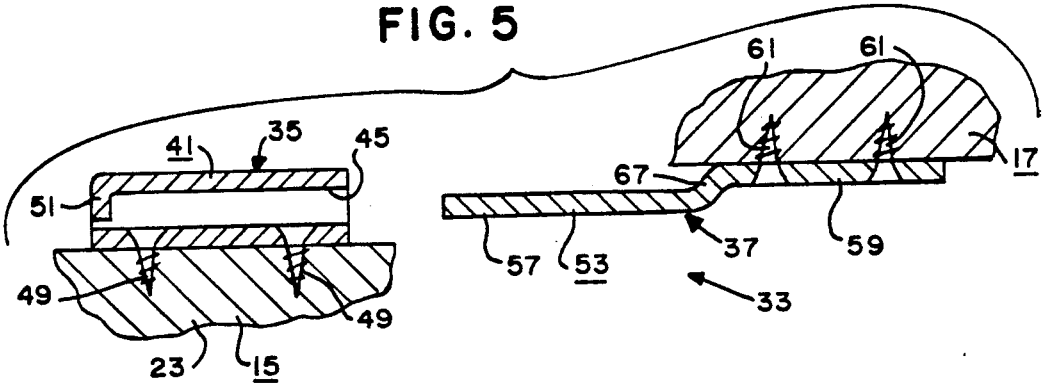
FIG. 5 is an exploded sectional view of the connecting means of FIG. 4 with each member of the connecting means attached to a portion of a furniture piece.
Figure 6:
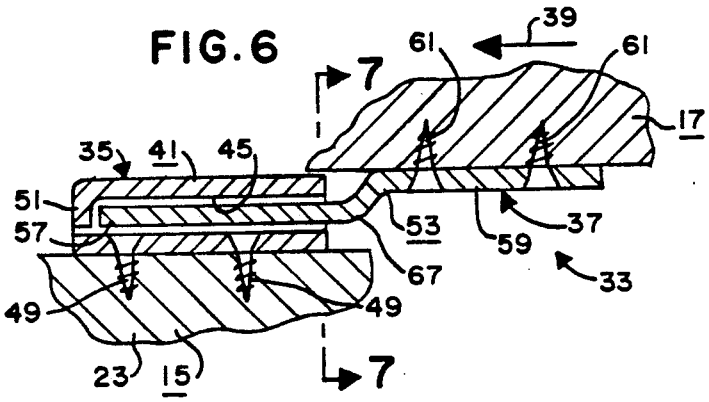
FIG. 6 is a sectional view of the connecting means of FIG. 5 with each member there joined together.

The joining means of the present invention includes a second connecting means 69 for connecting the first end 23 of the seat portion 15 and the first end 27 of the back portion 19 together. The second connecting means 69 includes a first member 71 for being attached to the first end 23 of the seat portion 15 and includes a second member 73 for being attached to the first end 27 of the back portion 19 (see FIGS. 1 and 2) in positions so that the second connecting means 69 will join the first end 23 of the seat portion 15 and the first end 23 of the back portion 19 to one another when the first and second members 71, 73 are brought into engagement with one another and the back portion 19 is moved in a second direction relative to the seat portion 15 as indicated by the arrow 75 in FIG. 3. The second connecting means 69 may be constructed in various specific manners which allow the seat portion 15 and the back portion 19 to be joined together when the first an second members 71, 73 are brought into engagement with one another and the back portion 19 is moved in a second direction relative to the seat portion 15 as indicated by the arrow 75 in FIG. 3. The specific construction of the first and second members 71, 73 is preferably identical to that of the respective first and second members 35, 37 of the first connecting means 33 and reference to the above description of the first and second members 35, 37 should be made for a more complete understanding of the construction of the first and second members 71, 73. The difference in operation between the first and second connecting means 33, 69 is due to the arrangement of the respective first and second members 35, 37, 71, 73 on the furniture piece 13. More specifically, with the seat portion 15 resting on a support surface (e.g., a floor) in a typical horizontal position, the first and second members 35, 37 of the first connecting means 33 are arranged on the seat portion 15 and first side portion 17 with the channels 45, 47 and tongue portion 57 arranged so that movement of the first side portion 17 in a horizontal direction after the first and second members 35, 37 are brought into engagement with the forward end of the tongue portion 57 located at the mouth of the channels 45, 47 as shown in FIGS. 4 and 5 will be effective to join the first and second members 33, 35 and, therefore, the seat portion 15 and first side portion 17 together. On the other hand, with the seat portion 15 resting on a support surface (e.g., a floor) in a typical horizontal position, the first and second members 71, 73 of the second connecting means 69 are arranged on the seat portion 15 and the back portion 19 with the channels and tongue portion thereof arranged so that movement of the back portion 19 in a vertical direction after the first and second members 71, 73 are brought into engagement with the forward end of the tongue portion thereof located at the mouth of the channels as will now be apparent to those skilled in the art will be effective to join the first and second members 71, 73 and, therefore, the seat portion 15 and the back portion 19 together.

The joining means of the present invention preferably includes a third connecting means 77 for connecting the first side portion 17 and the first end 27 of the back portion 19 together. The third connecting means 77 includes a first member 79 for being attached to the first side portion 17 and includes a second member 81 for being attached to the first end 27 of the back portion 19 (see FIGS. 1 and 2) in positions so that the third connecting means 77 will join the first side portion 17 and the first end 23 of the back portion 19 to one another when the first and second members 79, 81 are brought into engagement with one another and the back portion 19 is moved in the second direction relative to the seat portion 15 as indicated by the arrow 75 in FIG. 3. The third connecting means 77 may be constructed in various specific manners which allow the first side portion 17 and the back portion 19 to be joined together when the first and second members 79, 81 are brought into engagement with one another and the back portion 19 is moved in the second direction relative to the seat portion 15 as indicated by the arrow 75 in FIG. 3. The specific construction of the first and second members 79, 81 is preferably identical to that of the respective first and second members 35, 37 of the first connecting means 33 and reference to the above description of the first and second members 35, 37 should be made for a more complete understanding of the construction and operation of the first and second members 79, 81. With the seat portion 15 resting on a support surface (e.g., a floor) in a typical horizontal position, the first and second members 79, 81 of the third connecting means 77 are arranged on the first side portion 17 and the back portion 19 with the channels and tongue portion thereof arranged so that movement of the back portion 19 in a vertical direction after the first and second members 79, 81 are brought into engagement with the forward end of the tongue portion thereof located at the mouth of the channels as will now be apparent to those skilled in the art will be effective to join the first and second members 79, 81 and, therefore, the first side portion 17 and the back portion 19 together.

The joining means of the present invention preferably includes a fourth connecting means 83 for connecting the second side portion 21 and the second end 25 of the seat portion 17 together. The fourth connecting means 83 includes a first member 85 for being attached to the second end 25 of the seat portion 15 and includes a second member 87 for being attached to the second side member 21 (see FIG. 1) in positions so that the fourth connecting means 83 will join the second end 25 of the seat portion 15 and the second side portion 21 to one another when the first and second members 85, 87 are brought into engagement with one another and the second side member 21 is moved in the first direction relative to the seat portion 15 as indicated by the arrow 89 in FIG. 2. The fourth connecting means 83 may be constructed in various specific manners which allow the seat portion 15 and the second side portion 21 to be joined together when the first and second members 85, 87 are brought into engagement with one another and the second side portion 21 is moved in the first direction relative to the seat portion 15 as indicated by the arrow 89 in FIG. 2. The specific construction of the first and second members 85, 87 is preferably identical to that of the respective first and second members 35, 37 of the first connecting means 33 and reference to the above description of the first and second members 35, 37 should be made for a more complete understanding of the construction and operation of the first and second members 85, 87. With the seat portion 15 resting on a support surface (e.g., a floor) in a typical horizontal position, the first and second members 85, 87 of the fourth connecting means 83 are arranged on the seat portion 15 and the second side portion 21 with the channels and tongue portion thereof arranged so that movement of the second side portion 21 in a horizontal direction after the first and second members 85, 87 are brought into engagement with the forward end of the tongue portion thereof located at the mouth of the channels as will now be apparent to those skilled in the art will be effective to join the first and second members 85, 87 and, therefore, the seat portion 15 and the second side portion 21 together.

The joining means of the present invention preferably includes a fifth connecting means 91 for connecting the second end 25 of the seat portion 15 and the second end 29 of the back portion 19 together. The fifth connecting means 91 includes a first member 93 for being attached to the second end 25 of the seat portion 19 and includes a second member 95 for being attached to the second end 29 of the back portion 19 (see FIGS. 1 and 2) in positions so that the fifth connecting means 91 will join the second end 25 of the seat portion 15 and the second end 29 of the back portion 19 to one another when the first and second members 93, 95 are brought into engagement with one another and the back portion 19 is moved in the second direction relative to the seat portion 15 as indicated by the arrow 75 in FIG. 3. The fifth connecting means 91 may be constructed in various specific manners which allow the seat portion 15 and the back portion 19 to be joined together when the first and second members 93, 95 are brought into engagement with one another and the back portion 19 is moved in the second direction relative to the seat portion 15 as indicated by the arrow 75 in FIG. 3. The specific construction of the first and second members 93, 95 is preferably identical to that of the respective first and second members 35, 37 of the first connecting means 33 and reference to the above description of the first and second members 35, 37 should be made for a more complete understanding of the construction and operation of the first and second members 93, 95. With the seat portion 15 resting on a support surface (e.g., a floor) in a typical horizontal position, the first and second members 93, 95 of the fifth connecting means 91 are arranged on the seat portion 15 and the back portion 19 with the channels and tongue portion thereof arranged so that movement of the back portion 19 in a vertical direction after the first and second members 93, 95 are brought into engagement with the forward end of the tongue portion thereof located at the mouth of the channels as will now be apparent to those skilled in the art will be effective to join the first and second members 93, 95 and, therefore, the seat portion 15 and the back portion 19 together.

The joining means of the present invention preferably includes a sixth connecting means 97 for connecting the second side portion 21 and the second end 29 of the back portion 19 together. The sixth connecting means 97 includes a first member 99 for being attached to the second side portion 19 and includes a second member 101 for being attached to the second end 29 of the back portion 19 (see FIGS. 1 and 2) in positions so that the sixth connecting means 97 will join the second side portion 21 and the second end 29 of the back portion 19 to one another when the first and second members 99, 101 are brought into engagement with one another and the back portion 19 is moved in the second direction relative to the seat portion 15 as indicated by the arrow 75 in FIG. 3. The sixth connecting means 97 may be constructed in various specific manners which allow the second side portion 21 and the back portion 19 to be joined together when the first and second members 99, 101 are brought into engagement with one another and the back portion 19 is moved in the second direction relative to the seat portion 15 as indicated by the arrow 75 in FIG. 3. The specific construction of the first and second members 99, 101 is preferably identical to that of the respective first and second members 35, 37 of the first connecting means 33 and reference to the above description of the first and second members 35, 37 should be made for a more complete understanding of the construction and operation of the first and second members 99, 101. With the seat portion 15 resting on a support surface (e.g., a floor) in a typical horizontal position, the first and second members 99, 101 of the sixth connecting means 97 are arranged on the second side portion 21 and the back portion 19 with the channels and tongue portion thereof arranged so that movement of the back portion 19 in a vertical direction after the first and second members 99, 101 are brought into engagement with the forward end of the tongue portion thereof located at the mouth of the channels as will now be apparent to those skilled in the art will be effective to join the first and second members 99, 101 and, therefore, the second side portion 21 and the back portion 19 together.

The preferred method of assembling the furniture piece 13 of the present invention comprises, in general, attaching the first member 35 of the first connecting means 33 to the first end 23 of the seat portion 15 and attaching the second member 37 of the first connecting means 33 to the first side portion 17; attaching the first member 71 of the second connecting means 69 to the first end 23 of the seat portion 15 and attaching the second member 73 of the second connecting means 69 to the first end 27 of the back portion 19; attaching the first member 79 of the third connecting means 77 to the first side portion 17 and attaching the second member 81 of the third connecting means 77 to the first end 27 of the back portion 19; attaching the first member 85 of the fourth connecting means 83 to the second end 25 of the seat portion 15 and attaching the second member 87 of the fourth connecting means 83 to the second side portion 21; attaching the first member 93 of the fifth connecting means 91 to the second end 25 of the seat portion 15 and attaching the second member 95 of the fifth connecting means 91 to the second end 25 of the seat portion 15; attaching the first member 99 of the sixth connecting means 97 to the second side portion 21 and attaching the second member 101 of the sixth connecting means 97 to the second end 29 of the back portion 19; joining the first side portion 17 to the first end 23 of the seat portion 15 by bringing the first and second members 35, 37 of the first connecting means 33 into engagement with one another and then moving the first side portion 17 in the first direction relative to the seat portion 15 as indicated by the arrow 39; joining the second side potion 21 to the second end 25 of the seat portion 1 5 by bringing the first and second members 85, 87 of the fourth connecting means 83 into engagement with one another and then moving the second side portion 21 in the first direction relative to the seat portion 15 as indicated by the arrow 89; and then joining the back portion 19 to the seat portion 15 and the first and second side portions 17, 21 by bringing the first and second members of the second, third, fifth and sixth connecting means 69, 77, 91, 97, respectively, into engagement with one another and then moving the back portion 19 in the second direction relative to the seat portion 15 as indicated by the arrow 75.

It should be noted that when the individual portions of the furniture piece 13 are joined to one another with the joining means of the present invention as above described, a synergistic effect takes place. More specifically, after the seat portion 15 and first side portion 17 are joined together using the first connecting means 33, movement of the first side portion 17 in a direction opposite the arrow 39 in FIG. 2 will serve to disconnect the first side portion 17 from the seat portion 15. However, once the back portion 19 is coupled to the seat portion 15 and first side portion 17, it will then be impossible to move the first side portion 17 in a direction opposite the arrow 39 unless and until the back portion 19 is removed from the seat portion 15 and first side portion ? 7 as will now be apparent to those skilled in the art. A similar effect will occur with the second side portion 21. The present invention will thus result in a furniture piece 13 that can be easily stored and shipped in an unassembled manner in a relatively small container, etc., and that can be easily, quickly, and safely assembled in a rigid manner.

Although the present invention has been described and illustrated with respect to a preferred embodiment and a preferred use therefor, it is not to be so limited since modifications and changes can be made therein which are within the full intended scope of the invention.

We claim:

1. Joining means for removably joining a first portion, a second portion and a third portion of a furniture piece together, said joining means comprising:

a) a first connecting means, said first connecting means including a first member for being attached to said first portion of said furniture piece and including a second member for being attached to said second portion of said furniture piece in positions so that said first connecting means will join said first portion of said furniture piece and said second portion of said furniture piece to one another when said first and second members of said first connecting means are brought into engagement with one another and said second portion of said furniture piece is moved in a first direction relative to said first portion of said furniture piece; and b) a second connecting means, said second connecting means including a first member for being attached to said first portion of said furniture piece and including a second member for being attached to said third portion of said furniture piece in positions so that said second connecting means will join said first portion of said furniture piece and said third portion of said furniture piece to one another when said first and second members of said second connecting means are brought into engagement with one another and said third portion of said furniture piece is moved in a second direction relative to said first portion of said furniture piece;

said second direction being transverse to said first direction.

2. The joining means of claim 1 in which is included a third connecting means, said third connecting means including a first member for being attached to said second portion of said furniture piece and including a second member for being attached to said third portion of said furniture piece in positions so that said third connecting means will join said second portion of said furniture piece and said third portion of said furniture piece to one another when said first and second members of said third connecting means are brought into engagement with one another and said third portion of said furniture piece is moved in said second direction relative to said first portion of said furniture piece.

3. The joining means of claim 2 in which said furniture piece includes a fourth portion; in which is included a fourth connecting means, said fourth connecting means including a first member for being attached to said first portion of said furniture piece and including a second member for being attached to said fourth portion of said furniture piece in positions so that said fourth connecting means will join said first portion of said furniture piece and said fourth portion of said furniture piece to one another when said first and second members of said fourth connecting means are brought into engagement with one another and said fourth portion of said furniture piece is moved in said first direction relative to said first portion of said furniture piece; in which is included a fifth connecting means, said fifth connecting means including a first member for being attached to said first portion of said furniture piece and including a second member for being attached to said third portion of said furniture piece in positions so that said fifth connecting means will join said first portion of said furniture piece and said third portion of said furniture piece to one another when said first and second members of said fifth connecting means are brought into engagement with one another and said third portion of said furniture piece is moved in said second direction relative to said first portion of said furniture piece; and in which is included a sixth connecting means, said sixth connecting means including a first member for being attached to said fourth portion of said furniture piece and including a second member for being attached to said third portion of said furniture piece in positions so that said sixth connecting means will join said fourth portion of said furniture piece and said third portion of said furniture piece to one another when said first and second members of said sixth connecting means are brought into engagement with one another and said third portion of said furniture piece is moved in said second direction relative to said first portion of said furniture piece.

4. The joining means of claim 3 in which said first member of each of said connecting means includes a female slide member; and in which said second member of each of said connecting means includes a male slide member for coacting with said female slide member.

5. A furniture piece comprising:

a) a seat portion having a first end and a second end;

b) a back portion having a first end and a second end;

c) a first side portion; and d) joining means for removably joining said seat portion, said back portion, and said first side portion, said joining means including:

i) a first connecting means for removably joining said first end of said seat portion and said first side portion to one another when said first end of said seat portion and said first side portion are brought into engagement with one another and said first side portion is moved in a first direction;

ii) a second connecting means for removably joining said first end of said seat portion and said first end of said back portion to one another when said first end of said seat portion and said first end of said back portion are brought into engagement with one another and said first end of said back portion is moved in a second direction; and iii) a third connecting means for removably joining said first end of said back portion and said first side portion to one another when said first end of said back portion and said first side portion are brought into engagement with one another and said back portion is moved in said second direction;

said second direction being transverse to said first direction.

6. The furniture piece of claim 5 in which is included a second side portion; and in which said joining means includes:

iv) a fourth connecting means for removably joining said second end of said seat portion and said second side portion to one another when said second end of said seat portion and said second side portion are brought into engagement with one another and said second side portion is moved in said first direction;

v) a fifth connecting means for removably joining said second end of said seat portion and said second end of said back portion to one another when said second end of said seat portion and said second end of said back portion are brought into engagement wit one another and said second end of said back portion is moved in said second direction; and vi) a sixth connecting means for removably joining said second end of said back portion and said second side portion to one another when said second end of said back portion and said second side portion are brought into engagement with one another and said second end of said back portion is moved in said second direction.

* * * * *